US008157490B2

(12) United States Patent
Park

(10) Patent No.: US 8,157,490 B2
(45) Date of Patent: Apr. 17, 2012

(54) METHOD OF SECURING FREIGHT CONTAINERS ON DECK OF SHIP, AND SPRING LASHING BAR, SPACE ADJUSTER AND SECURING SYSTEM USED IN THE METHOD

(75) Inventor: Jae-Wook Park, Seoul (KR)

(73) Assignees: Jae-Wook Park, Seoul (KR); Mi-Yeong Kim, Seoul (KR)

( * ) Notice: Subject to any disclaimer, the term of this patent is extended or adjusted under 35 U.S.C. 154(b) by 241 days.

(21) Appl. No.: 12/555,130

(22) Filed: Sep. 8, 2009

(65) Prior Publication Data

US 2010/0074708 A1 Mar. 25, 2010

(30) Foreign Application Priority Data

Sep. 8, 2008 (KR) ..... 10-2008-088210

(51) Int. Cl.
*B60P 7/08* (2006.01)

(52) U.S. Cl. ..... 410/32

(58) Field of Classification Search ..... 410/31, 410/32, 35, 68, 78, 80, 82, 85; 24/287; 414/802, 414/803; 114/75
See application file for complete search history.

(56) References Cited

U.S. PATENT DOCUMENTS 6,669,417 B2 * 12/2003 Hsieh ..... 410/85
7,121,777 B2 * 10/2006 Tatina ..... 410/68

FOREIGN PATENT DOCUMENTS

KR 10-0768357 B1 10/2007

OTHER PUBLICATIONS

France, William N., et al., "An Investigation of Head-Sea Parametric Rolling and its Influence on Container Lashing Systems," SNAME Annual Meeting 2001 Presentation, pp. 1-24.
"A Master's Guide to Container Securing," Lloyd's Register and the Standard P & I Club, Charles Taylor & Co., Ltd., International House, 1 St. Katharine's Way, London E1W 1UT, www.standard-club.com, pp. 1-38.
Carefully to Carry, Issue 7, Jan. 2004, Thomas Miller & Co. Ltd., International House, 26 Creechurch Lane, London EC3A 5BA, pp. 1-26.
All Set Marine Lashing, Stackweight Tables General, STO-0674 swt, Feb. 15, 2005, pp. 1-2. All Set Marine Lashing, Appendix 1—Stackweight Tables on Deck, STO-0674 APP, Nov. 2, 2004, pp. 1-22.
All Set Marine Lashing, NVA 8400 TEU Stack Weight Calculation, 20ft bays, Standard Acceleration, Nov. 22-23, 2004, pp. 1-22.
All Set Marine Lashing, STO-0674 APP, Appendix 2, Additional Stackweight Tables Bays aft of Superstructure, Mar. 8, 2005, pp. 1-19.

* cited by examiner

*Primary Examiner* — Stephen Gordon
(74) *Attorney, Agent, or Firm* — McDermott Will & Emery LLP

(57) ABSTRACT

The present invention provides a method of securing freight containers on a deck of a large ship, and a spring lashing bar, a space adjuster and a securing system used in the method. In the method of the present invention, a movable lift is installed on a rail provided on a lashing bridge so as to be movable in a horizontal direction and a vertical direction. Freight containers are aligned with each other using tensile force generated in a horizontal direction by a container aligning device provided on a work table provided on the movable lift. The freight containers are coupled to each other using twistlocks in a vertical direction. Subsequently, adjacent left and right containers are coupled to each other using couplers and variable type coupling devices such that the freight containers are integrated with each other along an entire width of the ship or some width thereof.

4 Claims, 6 Drawing Sheets

METHOD OF SECURING FREIGHT CONTAINERS ON DECK OF SHIP, AND SPRING LASHING BAR, SPACE ADJUSTER AND SECURING SYSTEM USED IN THE METHOD

CLAIM OF PRIORITY

This application claims priority to Korean Patent Application Serial No. 10-2008-088210, filed on Sep. 8, 2008 which is incorporated herein by reference in its entirety.

BACKGROUND OF THE INVENTION

1. Field of the Invention

The present invention relates to a method of securing freight containers on a deck of a large ship such that the freight containers can effectively withstand external force, such as inclined loads and horizontal loads, generated by rolling movement of the ship, thus ensuring safe container transportation, and increasing the effective load of the freight containers, and a spring lashing bar, a space adjuster and a securing system used in the method.

2. Description of the Related Art

Generally, freight containers to be stacked on decks of ships are box type cases for efficiently and economically receiving and transporting cargo. The freight containers have a standardized width of 8 feet. Furthermore, the freight containers typically have lengths of 20 feet or 40 feet and heights of 8 feet, 8.5 feet or 9.5 feet.

Such a freight container makes it possible to conveniently transport special cargo as well as general goods without requiring a separate outer packing process, thus reducing working time and expense. Furthermore, the freight container can prevent incidents such as the damage, loss or theft of cargo. In addition, in the case of the use of the freight container, work of loading or unloading freight containers on a freight train, a freight car or a ship can be mechanized, so that there is an advantage in that the time required for the loading and unloading operation is markedly reduced.

To benefit from these advantages, recently, large ships have been used to transport a large number of freight containers to realize a reduction in transportation costs, for example, six or more tiers of containers are stacked on the deck of the ship to load several thousand freight containers on the deck of the container ship.

Furthermore, because of an increase in size of ships and the stability thereof, eight or more tiers of containers can be loaded on a deck. However, because the securing force and the self-strength of the containers are insufficient, only light containers, for example, almost empty containers, are loaded on a fifth tier of container and above.

FIG. 1 is a view illustrating a method of securing freight containers on a deck of a container ship according to a typical art.

As shown in the drawing, in the case of a very large container ship, to increase the efficiency of securing freight containers, a lashing bridge 20 having a height corresponding to that of one or two tiers of containers is provided in the lateral direction of the ship. The lashing bridge 20 functions to raise the height of the container support point of the ship to respond to an increase of the number of tiers of containers.

Typically, to couple freight containers 10 on the deck with respect to the vertical direction, twistlocks 11 are coupled between the freight containers 10. Thereafter, to increase the strength of resistance against inclined loads and lateral loads, the containers 10 are fastened to the lashing bridge 20 using lashing bars 12, which are provided in an "X" shape.

However, as shown in the drawing, the X-shaped securing method can be used only with one or two tiers of containers, because of problems pertaining to the length of each securing device and the fact that the weight is proportional to the length thereof. Furthermore, although the containers are secured to a double lashing bridge 20, the securing force is not sufficient, because it depends on the thickness of the lashing bars. In addition, freight containers, which are disposed above the containers that are secured by the X-shaped securing method, are secured using only the twistlocks 11 in the vertical direction.

Furthermore, in the very large container ship, six or more tiers of freight containers can be stacked on the deck, but lower portions of a third or fourth tier of freight containers are fastened to the lashing bridge 20, and freight containers which are disposed below the third or fourth tier are secured only to each other in the vertical direction. With regard to the reason for this, the stacks of containers are stacked on a hatch cover 13, and the hatch cover 13 is movable relative to the ship body to prevent the hatch cover 13 from being affected by elastic deformation of the ship body attributable to waves of the sea, thus preventing damage to the hatch cover 13. Therefore, in the case where the freight containers 10 are secured to the lashing bridge 20 fixed to the ship body, freight containers which are disposed below the third or fourth tier must be secured only to each other in the vertical direction to have play between them and the ship body, thus coping with the deformation of the ship body.

Therefore, the lashing bars 12 must not be tied tightly. Due to this, the very large container ship which has a relatively large deformation rate may make sailing very dangerous. For example, under conditions of rough weather, such as a typhoon or rough waves, the container ship rolls severely, so that the freight containers that are stacked to a high height may be disconnected from each other by the rolling force of the ship and the lashing bar 12 may be snapped. Thus, the containers may fall into the sea. Moreover, in the case where the connection of the containers is broken in the middle portion of the stack of containers, the adjacent stack of containers and other stacks may subsequently collapse like dominoes.

In an effort to overcome the above problems, a technique was proposed in Korean Patent Registration No. 0768357, which was filed by the applicant of the present invention and entitled "Method of securing freight containers". In this technique, adjacent containers of each tier can be secured to each other in the lateral direction such that they can effectively withstand inclined loads and horizontal loads generated by rolling movement and other complex movements of a ship, thus ensuring safe container transportation.

However, the above-mentioned method does not provide auxiliary equipment for securing containers on a deck, so that it is very difficult to actually use the method.

SUMMARY OF THE INVENTION

Accordingly, the present invention has been made keeping in mind the above problems occurring in the prior art, and an object of the present invention is to provide a method of securing freight containers on a deck of a large ship, in which eight or more tiers of freight containers stacked on the deck can have appropriate effective loads, and which can be conducted more reliably and safely, compared to the conventional securing method, and a spring lashing bar, a space adjuster and a securing system used in the method.

Another object of the present invention is to ensure safe transportation of the containers loaded on the deck of the ship and markedly increase the effective transportation ability of containers, thus markedly enhancing economic profitability.

In an aspect, the present invention provides a method of securing freight containers on a deck of a ship, including: installing a movable lift on a rail provided on a lashing bridge so as to be movable in a horizontal direction and a vertical direction, the lashing bridge provided on the ship in a lateral direction; aligning freight containers with each other using tensile force generated in a horizontal direction by a container aligning device provided on a work table provided on the movable lift; coupling the freight containers to each other using twistlocks in a vertical direction; and coupling adjacent left and right containers to each other using couplers and variable type coupling devices such that the freight containers are integrated with each other along an entire width of the ship or some width thereof.

The method may further include: coupling a spring lashing bar to the lashing bridge and lashing upper portions of first and second tiers of freight containers using the spring lashing bar to increase resistance of the freight containers against a horizontal load.

Furthermore, a support may be provided on the work table of the movable lift. The support may be operated in conjunction with the container aligning device to align the freight containers with each other.

The container aligning device may include: a hydraulic cylinder having a cylinder rod; and left and right arms coupled to the cylinder rod. The left and right arms may be rotated around hinges in response to linear movement of the cylinder rod, wherein the container aligning device aligns the adjacent freight containers with each other in the horizontal direction using the left and right arms.

In another aspect, the present invention provides a spring lashing bar, including: steel rods; a plate spring coupled between the steel rods to provide elasticity to the lashing bar, the plate spring rolled in a circular shape; and a turnbuckle coupled to one of the steel rods. The spring lashing bar is used in the method of securing freight containers on a deck of a ship.

In a further aspect, the present invention provides a space adjuster for freight containers stacked on a deck of a ship, including: a support provided on a work table of a movable lift installed on a lashing bridge; and a container aligning device installed on a front end of the support to provide tensile force to the freight containers in a horizontal direction, wherein the container aligning device includes: a casing; a hydraulic cylinder provided at a predetermined position on the casing, the hydraulic cylinder having a cylinder rod moving linearly; a lateral beam provided on a front end of the cylinder rod; connection links respectively coupled to both ends of the lateral beam so as to be rotatable around hinges; and left and right arms respectively coupled to the connection links.

The movable lift may include: a truck moving along a rail provided on the lashing bridge; and an X-shaped extension link provided on the truck, the X-shaped extension link being extended or contracted by operation of a hydraulic device in a vertical direction.

In yet another aspect, the present invention provides a system for securing freight containers on a deck of a ship, including: a movable lift provided on a lashing bridge so as to be movable in a horizontal direction along a rail provided on the lashing bridge, the movable lift having a work table to be moved upwards or downwards by operation of a hydraulic device; a container aligning device installed on the work table of the movable lift, the container aligning device comprising: a hydraulic cylinder having a cylinder rod moving linearly; and left and right arms connected to the cylinder rod, the left and right arms being rotated around hinges by linear movement of the cylinder rod to apply tensile force to the freight containers; a coupler, comprising: a coupler body; levers provided on the coupler body; and locking protrusions to be rotated by the levers, the locking protrusions being removably inserted into corresponding front holes of corner fittings provided on corners of the freight containers; and a variable type coupling device, having a housing, a handle provided on the housing, and coupling protrusions provided in the housing, the coupling protrusions being removably inserted into corresponding side holes of the corner fittings of the freight containers by rotating the handle.

The coupler may further include an insert protrusion to be inserted between adjacent left and right freight containers. The locking protrusions may be provided on opposite sides of the insert protrusion. The locking protrusions may be respectively inserted into the corresponding front holes of the corner fittings of the adjacent left and right freight containers and locked to or released from the front holes of the corner fittings depending on rotation of the levers.

The variable type coupling device may include: the housing; the handle provided on the housing; a worm gear provided in the casing, the worm gear being reversibly rotated by manipulating the handle; a pair of screw shafts engaging with the worm gear so as to be movable left and right; and movable blocks provided on ends of the screw shafts so as to be slidable in the housing, each of the movable blocks having the coupling protrusions to be removably inserted into the side holes formed in the corresponding corner fittings of the adjacent left and right freight containers.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a method of securing freight containers on a deck of a ship, a spring lashing bar used in the freight container securing method, a space adjuster for freight containers and a system for securing freight containers according to a preferred embodiment of the present invention will be described in detail with reference to the attached drawings.

Figure 1:
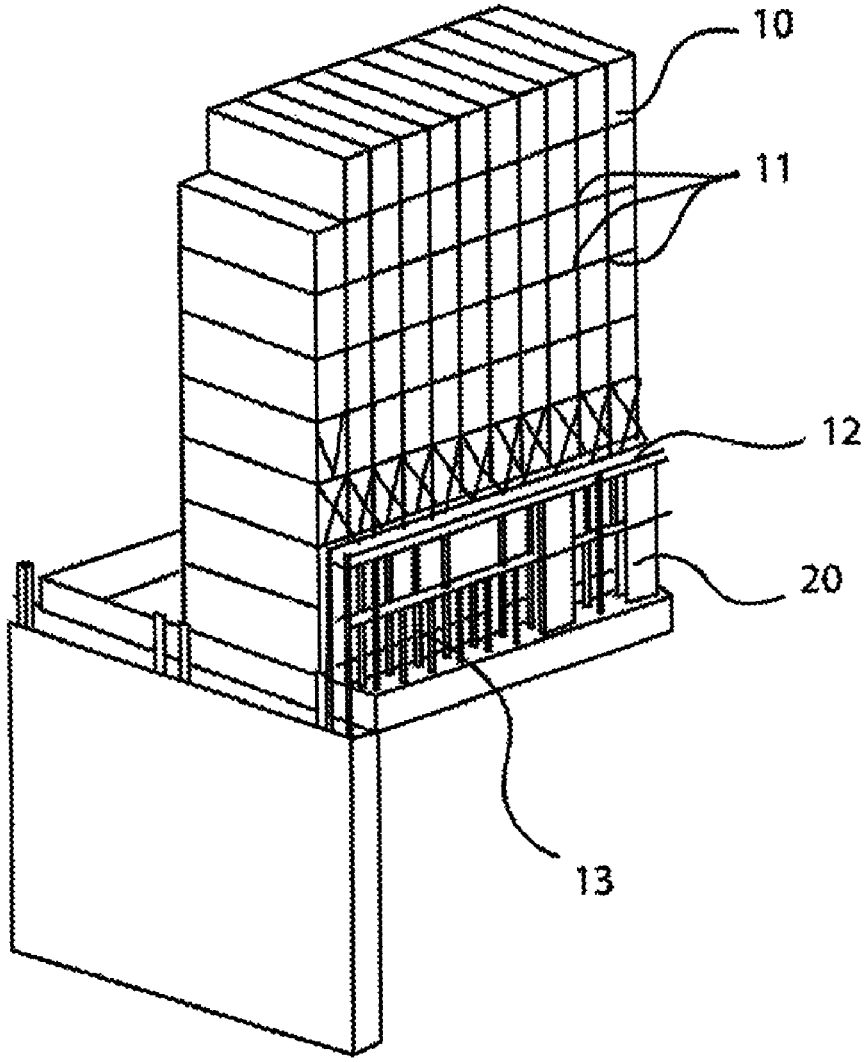
FIG. 1 PRIOR ART
FIG. 1 is a view illustrating a conventional method of securing freight containers on a deck of a ship.
Figure 2:
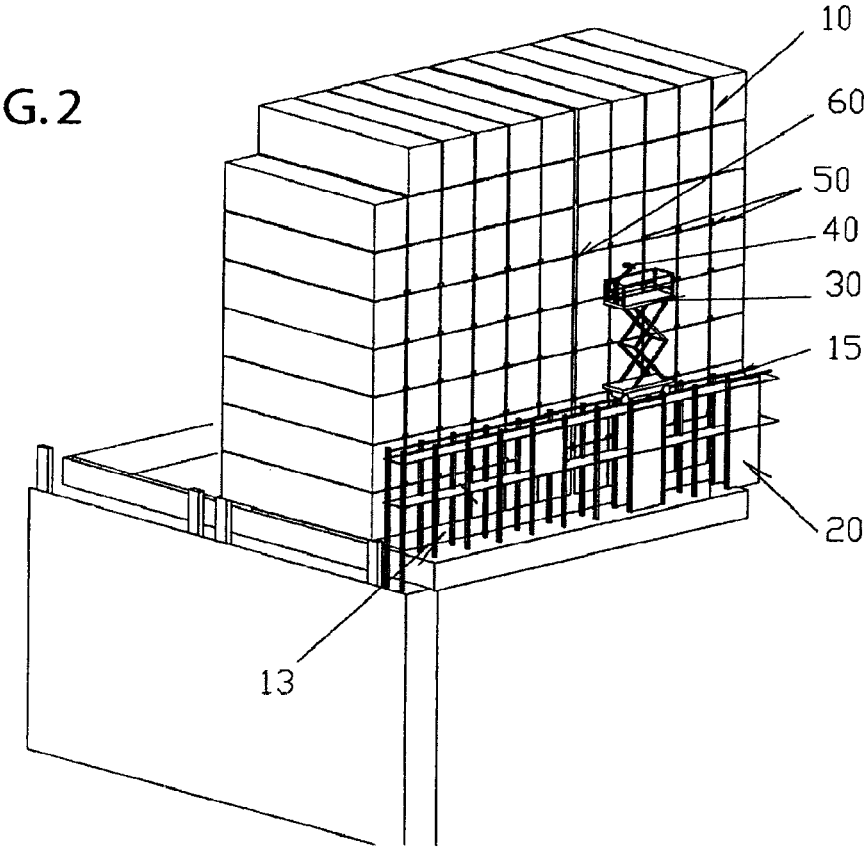
FIG. 2 is a view illustrating a method of securing freight containers on a deck of a ship, according to an embodiment of the present invention.

FIG. 2 is a view illustrating a method of securing freight containers on a deck of a ship according to the present invention. A method of securing eight tiers of containers 10 having predetermined weights with respect to the vertical direction using twistlocks 11 is the same as that of the conventional technique shown in FIG. 1, therefore a further detailed explanation will be omitted.

To stack freight containers on the deck of the ship, a movable lift 30 is installed on the lashing bridge 20 which is provided on the ship in the lateral direction. The movable lift 30 is slidable on the lashing bridge 20 in the lateral direction of the ship and is constructed such that a work table 35 can be moved in the vertical direction by the operation of a hydraulic device 33. This construction is a well known technique.

Furthermore, in the present invention, a support 41 is installed on the work table 35 of the movable lift 30. A container aligning device 40 which is operated using hydraulic pressure is supported by the support 41. The container aligning device 40 adjusts distances between the containers 10 with respect to the front, rear, left and right directions, after the containers 10 are secured on the deck with respect to the vertical direction by a harbor crane (not shown).

Here, the container aligning device 40 may be removably mounted to the support 41 that is installed on the work table 35.

After the containers 10 are aligned with each other by adjusting the distances therebetween, a worker couples the containers 10 in the lateral direction using couplers 50 and variable type coupling devices 60.

Although each stack of containers 10 that are coupled to each other in the vertical direction is coupled to adjacent stacks of containers 10 to provide lateral structural continuity, the strength against the lateral load of the containers 10 is not satisfactorily improved, in theory. Therefore, in the case of an excessive lateral load being anticipated, the containers 10 are fastened to an external structure to prevent deformation of the stacks of containers 10. The typical lashing bridge 20 plays a role of the external structure.

However, due to slipping of the hatch cover 13, if excessive force attributable to deformation of the ship body is applied to the lashing bar 12, the lashing bar 12 may be easily snapped.

In other words, generally, the container ship is a marine structure having a large opening. Therefore, the twisting of the ship body because of waves is severer than that of other kinds of ships. In addition, as the size of the ship body increases, the displacement of the twisting increases. Thus, to prevent the hatch cover 13 from being affected by the deformation of the opening, a sliding structure is provided in which a sliding pad is installed between the hatch cover 13 and the ship body.

In this case, relative displacement of about 80 mm to 100 mm occurs between the stack of containers placed on the hatch cover 13 and the lashing bridge 20 fixed to the ship body. The typical lashing bar 12 may be easily snapped. Hence, the upper surfaces of the containers of the lowermost tier are not reliably secured. In addition, the allowance load of the containers is limited.

In the present invention, to overcome the conventional problems, spring lashing bars 15 horizontally couple the upper portions of first and second tiers of freight containers 10 to fixing points of the lashing bridge 20. The number of spring lashing bars 15 is determined depending on a calculated lateral load.

Figure 3:
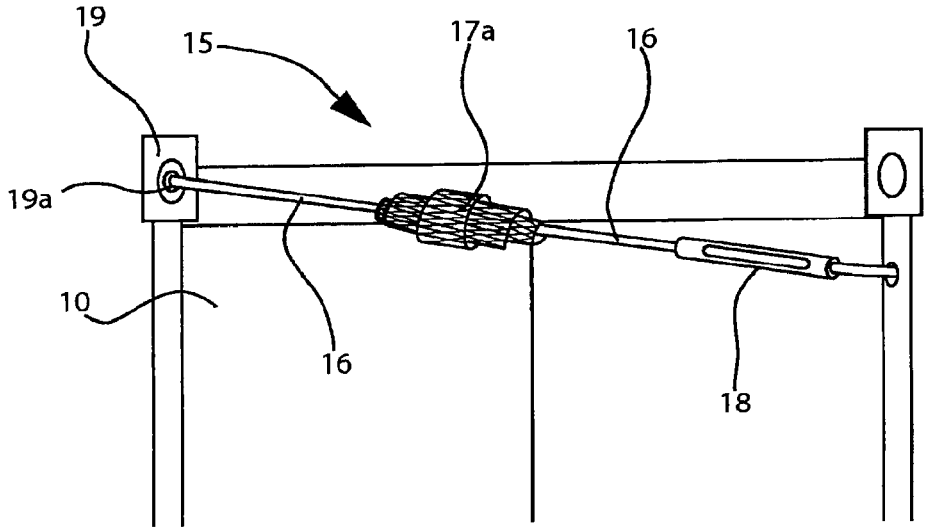
FIG. 3 is a view showing the installation of a spring lashing bar according to the present invention.

FIG. 3 illustrates one example of the spring lashing bar 15. The spring lashing bar 15 includes two steel rods 16 and a plate spring 17*a* which is rolled in a circular shape several times and is coupled at both ends thereof to the two steel rods 16 by welding. In the same manner as the conventional lashing bar 12, a first end of the spring lashing bar 15 is processed by thread cutting and is coupled to a turnbuckle 18 so as to be adjustable in length, and a second end thereof is formed such that it can be coupled to a corner fitting 19 of the freight container 10.

The spring lashing bar 15 having the above-mentioned construction can almost horizontally couple the corner fitting 19 of the freight container 10 to the corresponding fixing point of the lashing bridge 20, thus enabling the freight container 10 to withstand a lateral load. Furthermore, the spring lashing bar 15 has a tensile force of approximately 20 ton to 25 ton and is extendable within a range of 50 mm, so that it can effectively cope with the deformation of the ship body.

Furthermore, in the case of the first to fourth or fifth tiers of freight containers 10 out of the total of eight tiers of freight containers 10, the freight containers 10 placed in each tier can be coupled to or integrated with adjacent left and right freight containers 10 by the couplers 50 and the variable type coupling devices 60.

In this container securing method, freight containers 10, which are placed in the lower portion of a stack of freight containers 10, are integrated with each other so that the lower part of the stack of freight containers 10 forms a single body like a single freight container having a large width. Only three or four tiers of freight containers 10 from the top are vertically secured by twistlocks 11. Therefore, the present invention can effectively withstand inclined loads and lateral loads generated by rolling movement of the ship and by other types of movement thereof.

Furthermore, depending on the height to which freight containers 10 are stacked, the number of tiers for which the lateral securing is required can vary. Thus, the present invention makes it possible to more effectively load freight containers 10 on the ship.

Figure 4A:
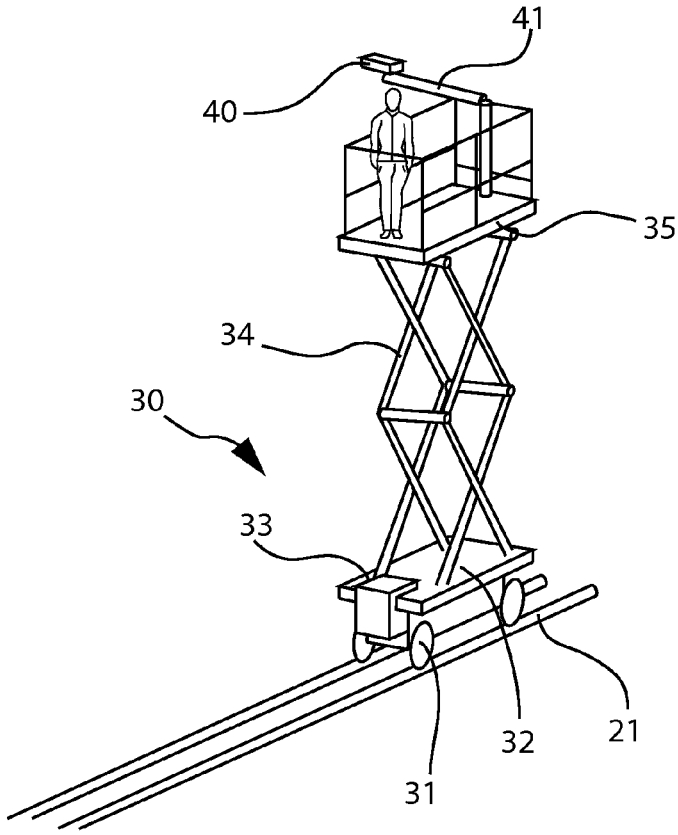
FIGS. 4A and 4B are perspective views illustrating the construction of a movable lift according to the present invention.
Figure 4B:
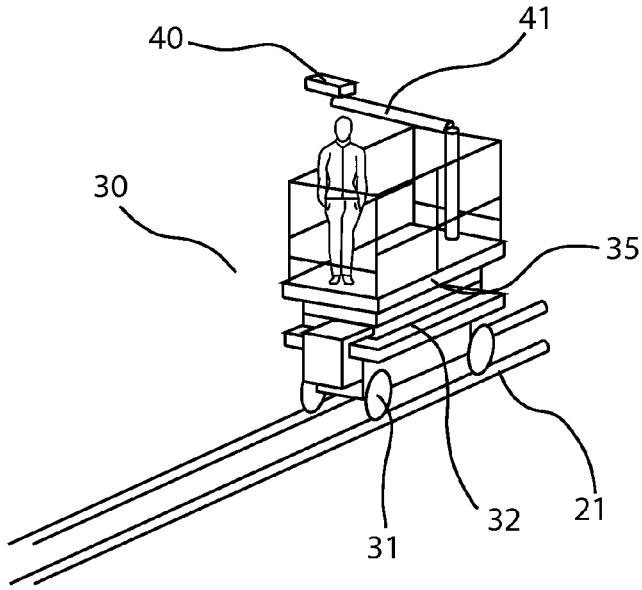

Meanwhile, FIGS. 4A and 4B are perspective views illustrating the construction of the movable lift 30 which is used to conduct the lateral securing of the freight containers 10. The movable lift 30 includes a truck 32 which has wheels to enable it to move along rails 21 installed on the lashing bridge 20. The movable lift 30 further includes an X-shaped extension link 34 which is provided on the truck 32 and is extended or contracted by the hydraulic device 33. The work table 35 is provided on the upper end of the X-shaped extension link 34, so that the work table 35 can be moved upwards or downwards by the extension or contraction of the X-shaped extension link 34.

The installation of the work table 35 on the X-shaped extension link 34 is a well known technique, other than the facts that the work table 35 is installed on a ship which runs on the sea and it has the support 41 for supporting the container aligning device 40. Therefore, further detailed explanation of the installation of the work table 35 will be omitted.

The support 41 for supporting the container aligning device 40 is installed on the work table 35. The support 41 has a rotatable structure to facilitate the work of aligning the freight containers 10, in other words, the work of adjusting the distances between the freight containers 10. Preferably, the container aligning device 40 has a structure capable of being removable from the support 41. In addition, a hydraulic pressure line required for adjusting the distances between the freight containers 10 can be configured using the hydraulic device 33 of the movable lift 30.

The system of the present invention must be suitable for marine conditions and be stable such that it does not move during the navigation of the ship.

Furthermore, in the case where freight containers having lengths of 20 feet are stacked on the deck of the ship, the movable lift 30 may be installed between the containers of 20 feet without having rails. In this case, the container aligning device 40 can be provided in the same manner.

Figure 5:
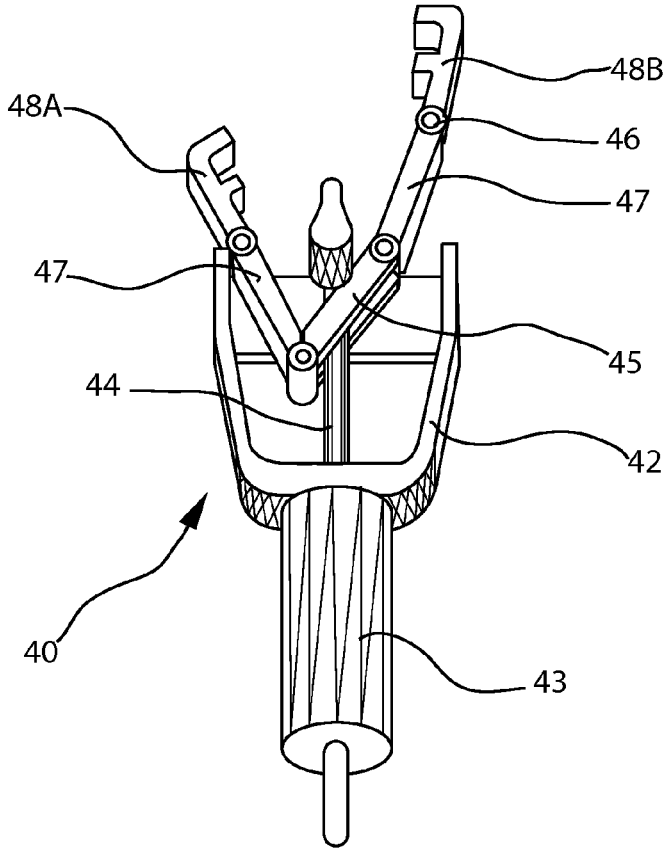
FIG. 5 is a perspective view showing a critical part of a container aligning device used to secure the freight containers on the deck according to the present invention.
Figure 6:
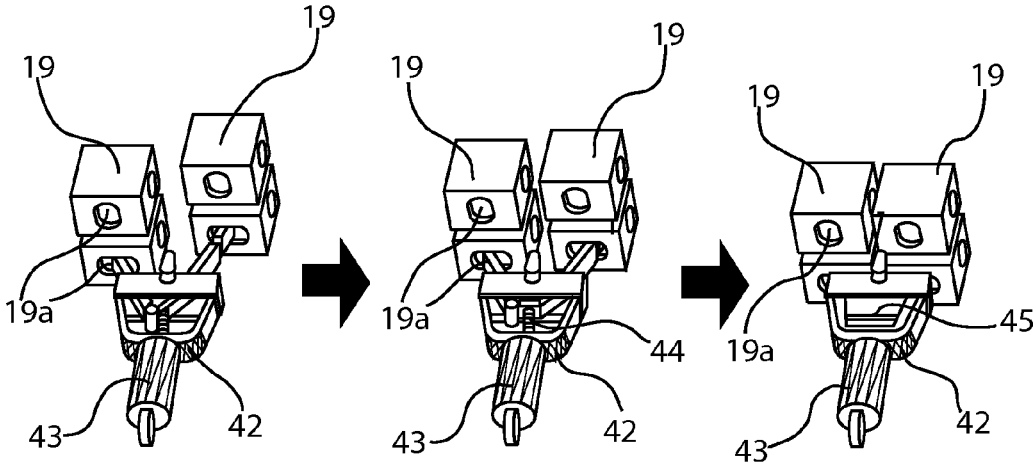
FIG. 6 is a view showing the operation of the container aligning device of FIG. 5.

FIG. 5 illustrates the container aligning device 40 of the space adjuster used to adjust the distances between the freight containers on the deck according to the present invention. FIG. 6 is a view showing the operation of the container aligning device 40.

As shown in the drawings, a hydraulic cylinder 43 is provided on one end of a casing 42. A lateral beam 45 is coupled to a cylinder rod 44 which is operated by the hydraulic cylinder 43. Connection links 47 are respectively connected to both ends of the lateral beam 45 by hinges 46. Two arms 48A and 48B are respectively coupled to the ends of the connection links 47.

To align the adjacent two freight containers 10 with each other, the two arms 48A and 48B hold the corresponding corner fittings 19 of the freight containers 10. Subsequently, when the cylinder rod 44 is linearly pulled by the operation of the hydraulic cylinder 43, one end of the lateral beam 45 is first brought into contact with the surface of the casing 42. Thereafter, the connection links 47 are rotated with respect to the lateral beam 45 by the operation of the hydraulic cylinder 43, and tensile force is applied to the arm 48A or 48B which is disposed adjacent to the other end of the lateral beam 45. Thereby, the freight containers 10 can be aligned with each other.

In detail, in the process of stacking the freight containers 10 on the deck using the harbor crane and of securing them to the deck, due to a clearance between the twistlock 11 and a hole formed in the corresponding corner fitting 19, as the height of the stack of containers is increased, the distances between the sidewalls of the adjacent containers 10 may be increased or reduced. Thus, the adjacent containers 10 may become misaligned from each other, for example, put into contact with each other or excessively spaced apart from each other.

For instance, the adjacent freight containers 10 may be spaced apart from each other by a distance of 30 mm to 40 mm in the lateral direction and by a distance of 40 mm to 50 mm in the longitudinal direction of the ship. In this case, the coupler 50 cannot be installed only using human power. Hence, the two arms 48A and 48B of the container aligning device 40 are inserted into front holes 19*a* formed in the corresponding corner fittings 19 of the freight containers. Thereafter, the hydraulic cylinder 43 is operated. Then, the arms 48A and 48B are pulled into the casing 42 along the inner surface of the casing 42.

Here, because the freight containers 10 which have been misaligned from each other are pulled by hydraulic pressure while reaction force is applied to the corner fittings 19 of the freight containers 10, the freight containers 10 which are relatively heavy can be aligned with each other without applying excessive force to the movable lift 30.

As such, after the freight containers 10 are aligned with each other, the coupler 50 is coupled to the front holes 19*a* of the corner fittings 19 which are disposed above the corner fittings 19 which are coupled to the container aligning device 40. After the locking of the coupler 50 is completed, the hydraulic pressure which has been applied to the hydraulic cylinder 43 is removed. Then, force which is reciprocally applied to the freight containers 10 through the container aligning device 40 is applied to each other through the coupler 50. Thus, subsequent process can be conducted after the arms 48A and 48B of the container aligning device 40 are released from the corner fittings 19.

Below, a method of securing adjacent freight containers 10 to each other in such a way as to couple the coupler 50 or the variable type coupling device 60 to the corresponding corner fittings 19 of the freight containers 10 will be explained in detail.

Figure 7:
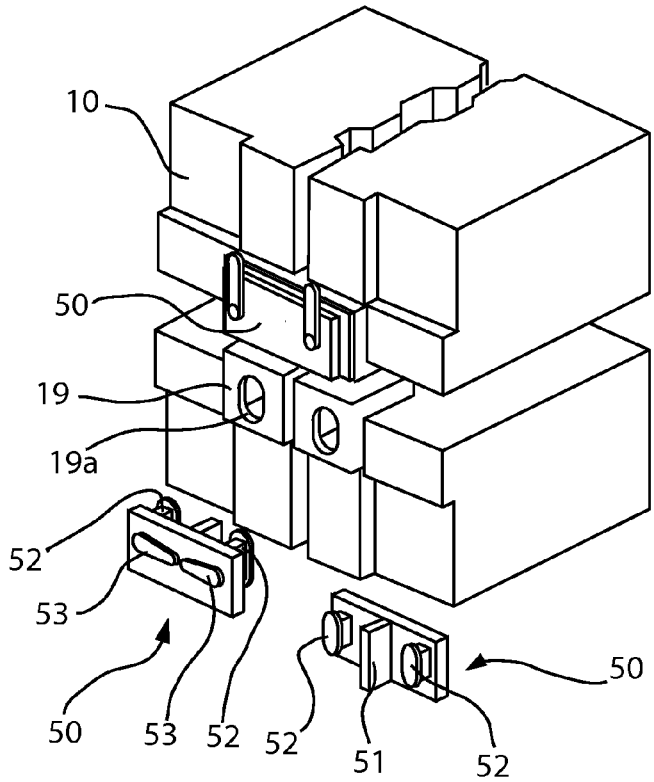
FIG. 7 is a perspective view showing the construction of a coupler according to the present invention.

FIG. 7 is a perspective view showing the coupling of the coupler 50 to the corner fittings 19. As shown in the drawing, the coupler 50 has a bilateral symmetric structure and includes an insert protrusion 51, which is provided at the medial position, and locking protrusions 52, which are symmetrically provided on opposite sides of the insert protrusion 51. The locking protrusions 52 are integrated with levers 53 which are disposed on the surface of the coupler 50 opposite to the surface on which the locking protrusions 52 are provided.

The insert protrusion 51 of the coupler 50 is inserted between adjacent freight containers 10. The locking protrusions 52 are respectively inserted into the front holes 19*a* formed in the corresponding corner fittings 19 of the adjacent freight containers 10.

Therefore, after the process of stacking the freight containers 10 using the harbor crane is completed and the couplers 50 are inserted into the corresponding front holes 19*a* of the corner fittings 19, the levers 53 are rotated 90°. Then, the locking protrusions 52 are rotated in the front holes 19*a* so that the locking protrusions 52 are locked to the corner fittings 19. Thereby, the couplers 50 can be reliably fastened to the freight containers 10. Hence, even if the ship excessively rolls, the couplers 50 are prevented from becoming disconnected from the freight containers 10.

Figure 8A:
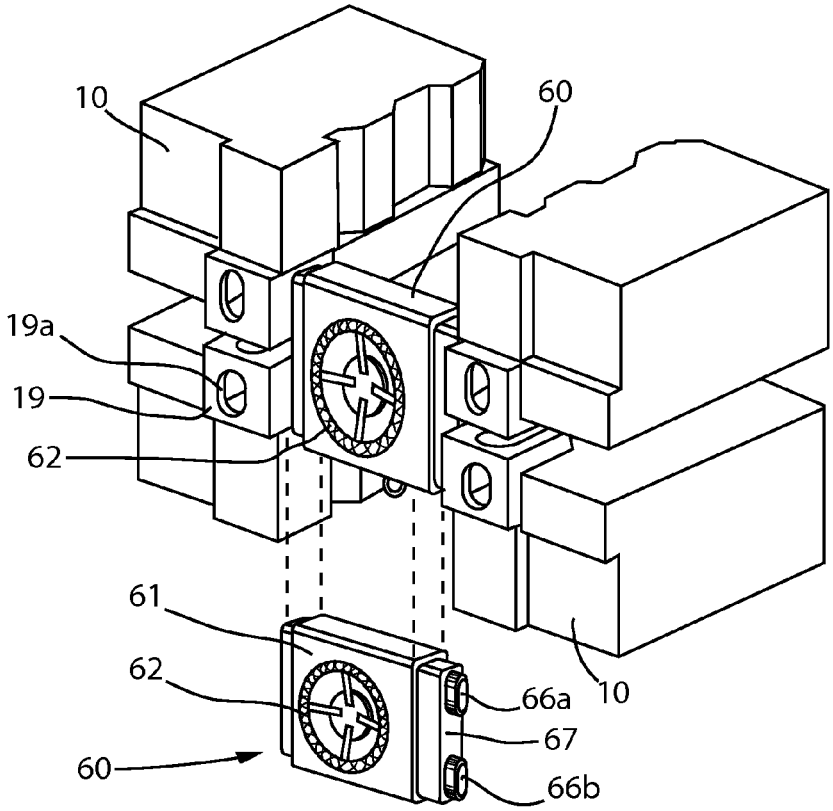
FIGS. 8A and 8B are perspectives showing the construction of a variable type coupling device.
Figure 8B:
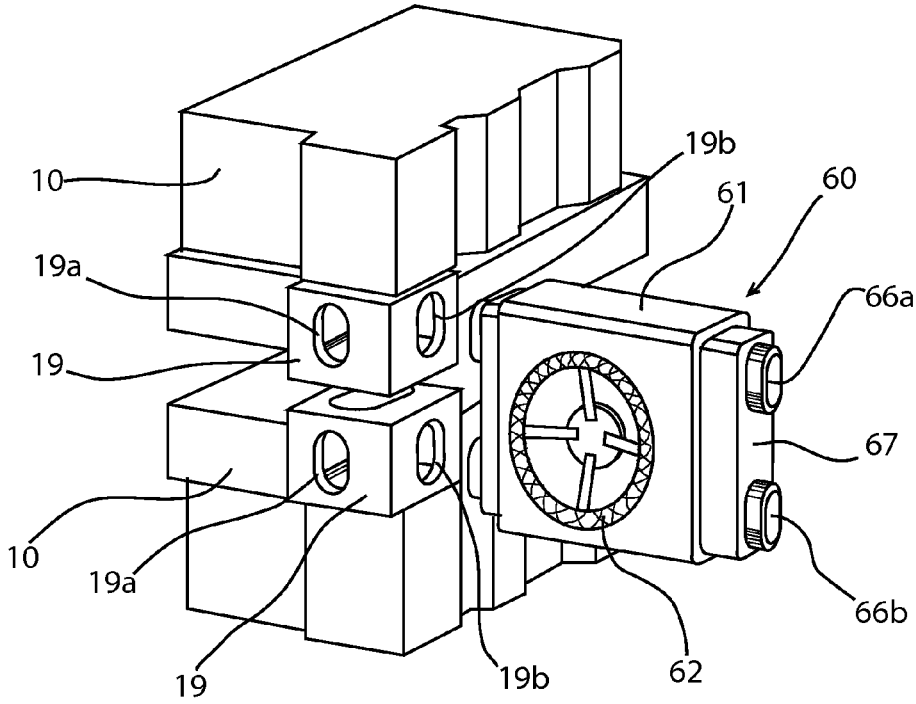
Figure 9:
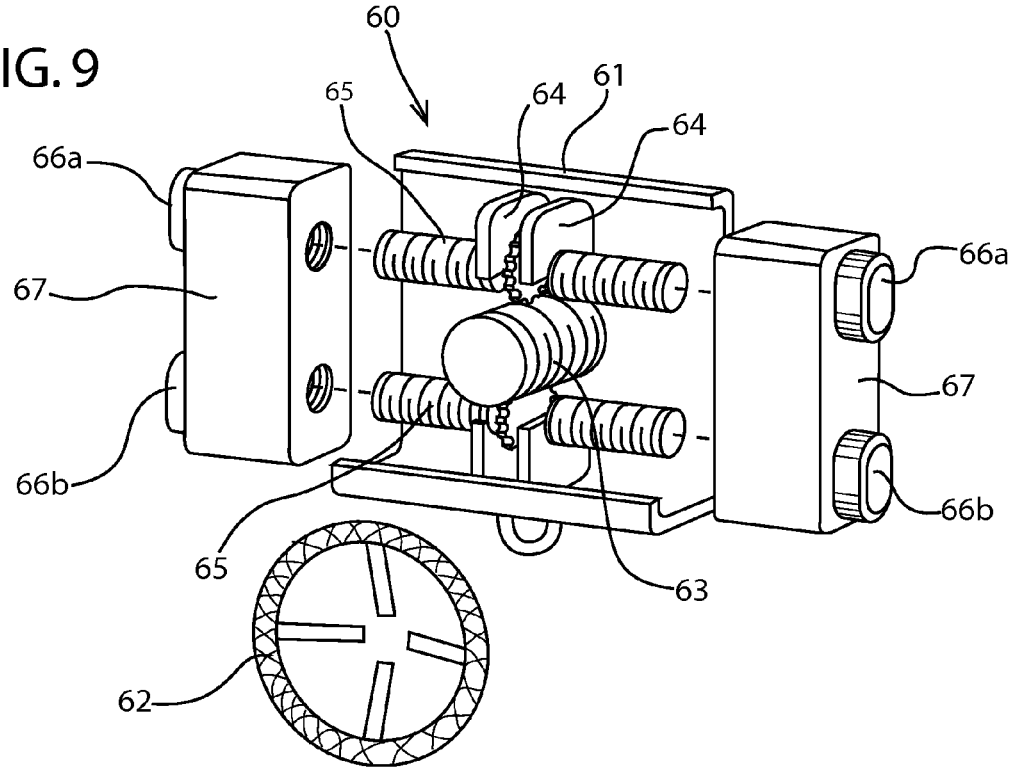
FIG. 9 is a view showing the internal construction of the variable type coupling device according to the present invention.

FIGS. 8A, 8B and 9 are views illustrating the coupling between the variable type coupling device 60 and the corner fittings 19. The variable type coupling device 60 functions to couple adjacent freight containers 10 to each other, the freight containers 10 being loaded on different hatch covers 13.

Typically, freight containers 10, which are loaded on the deck of the ship, are placed on hatch covers 13. Furthermore, the several hatch covers 13, which are separated from each other, are provided in the lateral direction of the ship. Therefore, at each hatch cover 13, gaps at which freight containers 10 are spaced apart from each other are constant. However, a gap between freight containers 10 increases at a position between two adjacent hatch covers 13. In addition, because the positions at which the hatch covers 13 are placed vary slightly when the hatch covers 13 are opened and closed, the gap between associated freight containers 10 may be different every time.

As shown in the drawings, the variable type coupling device 60 includes a housing 61, a manual handle 62 which is provided on the housing 61, and a worm gear 63 which is provided in the casing 61 and is rotated by manipulating the manual handle 62. The worm gear 63 engages with a pair of screw shafts 65 which are respectively supported by support brackets 64 so as to be movable in the lateral direction. Movable blocks 67 are connected to both ends of the screw shafts 65 so as to be slidable in the housing 61. Each movable block 67 has a pair of coupling protrusions 66*a* and 66*b* which is inserted into side holes 19*b* formed in the corner fittings 19 of the adjacent containers 10.

The coupling protrusions 66*a* and 66*b* of one of the movable blocks 67 of the variable type coupling device 60 are inserted into the side holes 19*b* of the corner fittings 19 of the containers 10 which are disposed at one side. Thereafter, the manual handle 62 is rotated. Then, the worm gear 63 and the screw shafts 65 are rotated in conjunction with each other. Hereby, the movable blocks 67 are extracted from the housing 61. Thus, the coupling protrusions 66*a* and 66*b* of the other movable block 67 are inserted into the side holes 19*b* of the corner fittings 19 of the freight containers 10 which are disposed at the opposite side.

In other words, the coupling protrusions 66*a* and 66*b* of the left movable block 67 are coupled to the corresponding corner fittings 19 of the left containers 10, and the coupling protrusions 66*a* and 66*b* of the right movable block 67 are coupled to the corresponding corner fittings 19 of the right containers 10. As such, the variable type coupling device 60 serves to couple the stacks of containers 10, which are placed on the adjacent hatch covers 13, to each other to ensure structural continuity, thus increasing resistance to inclined loads and lateral loads.

Here, because of the use of the worm gear 63, the variable type coupling device 60 can push the left and right freight containers 10 with great force in the directions in which the containers 10 move away from each other. Hereby, the variable type coupling device 60 is reliably locked to the adjacent freight containers 10. To release the locked state, the manual handle 42 is rotated in the reverse direction to remove the coupling protrusions 66*a* and 66*b* of the right movable blocks 67 from the side holes 19*b* of the corner fittings 19, thus allowing the variable type coupling device 60 to be removed from the freight containers 10.

Meanwhile, when eight tiers of containers having lengths of 40 feet are stacked on the deck of the ship without using the present invention, an approximate effective load to be applied to each stack is described in the following table.

| | Allowable load/stack Total 122 ton | Effective load/stack Total 94 ton |
|---|---|---|
| $8^{th}$ tier | 3.5 ton | 0 |
| $7^{th}$ tier | 3.5 ton | 0 |
| $6^{th}$ tier | 3.5 ton | 0 |
| $5^{th}$ tier | 6.5 ton | 3.0 ton |
| $4^{th}$ tier | 20 ton | 16.5 ton |
| $3^{th}$ tier | 25 ton | 21.5 ton |
| $2^{th}$ tier | 30 ton | 26.5 ton |
| $1^{th}$ tier | 30 ton | 26.5 ton |

Next, when eight tiers of containers having lengths of 40 feet are stacked on the deck of the ship using the present invention, an approximate effective load to be applied to each stack is described in the following table.

| | Allowable load/stack Total 180 ton | Effective load/stack Total 152 ton |
|---|---|---|
| $8^{th}$ tier | 15 ton | 11.5 ton |
| $7^{th}$ tier | 15 ton | 11.5 ton |
| $6^{th}$ tier | 20 ton | 16.5 ton |
| $5^{th}$ tier | 20 ton | 16.5 ton |
| $4^{th}$ tier | 25 ton | 21.5 ton |
| $3^{th}$ tier | 25 ton | 21.5 ton |
| $2^{th}$ tier | 30 ton | 26.5 ton |
| $1^{th}$ tier | 30 ton | 26.5 ton |

As shown in the tables, in the case where the system for securing the containers on the deck of the ship is used, it is to be understood that the effective load with respect to the allowable load of the containers on the deck is greatly increased. Furthermore, the present invention can provide the lateral structural continuity to the freight containers 10, thus increasing the ability to transport the freight containers 10 such that the ship can safely carry the freight containers 10.

As described above, the present invention provides a method of coping with a lateral load applied to freight containers stacked on a deck of a ship, thus markedly increasing the effective load of the freight containers. Despite increasing the effective load, the present invention can reduce the possibility of deformation or damage to the freight containers.

Furthermore, the present invention includes a lateral securing means which is used to provide lateral structural continuity to stacks of containers. Hence, the secured state of the stacks of containers can be reliably maintained, such that the containers can effectively withstand inclined loads and horizontal loads using their own strength. Thus, the present invention can markedly increase the effective load of the freight containers.

In addition, compared to the conventional technique, the present invention can more reliably and safely conduct the container securing work and increase the ability to carry the containers loaded on the ship so that the amount of containers that can be loaded on the ship is increased. Therefore, the present invention can not only ensure the safe transportation of the containers but also markedly enhance economic profitability.

Although the preferred embodiment of the present invention has been disclosed for illustrative purposes, the present invention is not limited to the above embodiment. Those skilled in the art will appreciate that various modifications, additions and substitutions are possible, without departing from the scope and spirit of the invention disclosed in the accompanying claims.

Therefore, such modifications, additions and substitutions must be regarded as falling within the bounds of the present invention.

What is claimed is:

1. A method for securing freight containers on a deck of a ship, comprising:

installing a movable lift on a rail provided on a lashing bridge or on a deck so as to be movable in a horizontal direction and a vertical direction, the lashing bridge provided on the ship in a lateral direction;

coupling the freight containers to each other using twistlocks in a vertical direction;

aligning the freight containers with each other by a container aligning device producing tensile force generated in a horizontal direction according to the operation of a hydraulic cylinder and to align the freight containers, the container aligning device provided on a work table provided on the movable lift;

coupling adjacent left and right ones of the containers on a same hatch cover to each other using couplers; and coupling adjacent left and right ones of the containers on different hatch covers to each other using variable type coupling devices such that the freight containers are coupled to or integrated with each other along an entire width of the ship or some width thereof.

2. The method as set forth in claim 1, further comprising:

coupling a spring lashing bar to the lashing bridge and lashing upper portions of first and second tiers of the freight containers using the spring lashing bar to increase resistance of the freight containers against a horizontal load.

3. The method as set forth in claim 1, wherein the container aligning device comprises:

a hydraulic cylinder having a cylinder rod; and left and right arms coupled to a lateral beam and to the cylinder rod, the left and right arms being rotated around hinges in response to linear movement of the cylinder rod, wherein the container aligning device aligns the adjacent ones of the freight containers with each other in a horizontal direction using the left and right arms.

4. The method as set forth in claim 2, wherein the spring lashing bar comprises:

steel rods;

a plate spring coupled between the steel rods to provide elasticity to the lashing bar, the plate spring rolled in a circular shape; and a turnbuckle coupled to one of the steel rods.

* * * * *